US005266045A

United States Patent [19]

Yamamoto et al.

[11] Patent Number: 5,266,045

[45] Date of Patent: Nov. 30, 1993

[54] WATERPROOF CONNECTOR

[75] Inventors: Takayuki Yamamoto; Akira Maeda, both of Shizuoka, Japan

[73] Assignee: Yazaki Corporation, Japan

[21] Appl. No.: 964,295

[22] Filed: Oct. 21, 1992

[30] Foreign Application Priority Data

Oct. 28, 1991 [JP] Japan ..... 3-088349[U]
Apr. 15, 1992 [JP] Japan ..... 4-024026[U]

[51] Int. Cl.[5] ..... H01R 13/52

[52] U.S. Cl. ..... 439/275; 439/587; 439/712

[58] Field of Search ..... 439/587–589, 439/595, 275, 272, 271, 712

[56] References Cited

U.S. PATENT DOCUMENTS 4,640,567 2/1987 Lundergan et al. ..... 439/712
4,713,021 12/1987 Kobler ..... 439/275
4,944,688 7/1990 Lundergan ..... 439/275
5,116,236 5/1992 Colleran et al. ..... 439/275

FOREIGN PATENT DOCUMENTS 61-169973 10/1986 Japan .
61-197668 12/1986 Japan .
63-61776 4/1988 Japan .
64-19271 1/1989 Japan .

*Primary Examiner*—Paula A. Bradley
*Attorney, Agent, or Firm*—Wigman, Cohen, Leitner & Myers

[57] ABSTRACT

A waterproof connector for accommodating therein a terminal which is connected to a wire has a housing. The housing has a terminal accommodating chamber for accommodating therein the terminal connected to the wire, and a waterproof-plug mounting section in communication with the terminal accommodating chamber. The waterproof-plug mounting section is provided with an opening at one end thereof. A waterproof plug is inserted into the waterproof-plug mounting section through the opening. The waterproof plug has an inserting bore into which the terminal connected to the wire is inserted. The waterproof plug is compressed axially whereby the waterproof plug swells radially so as to be into close contact with the wire and the waterproof-plug mounting section. An urging element is provided for compressing the waterproof plug axially so as to be engaged with the housing.

8 Claims, 9 Drawing Sheets

WATERPROOF CONNECTOR

BACKGROUND OF THE INVENTION

The present invention relates to a waterproof connector provided with a waterproof plug for sealing a location between a connector housing and a wire.

Conventional waterproof connectors include Japanese Utility Model Laid-Open No. 63-61776. This waterproof connector is illustrated in FIG. 1 of the attached drawings. FIG. 1 is a cross-sectional view showing a female connector 1 which serves as the waterproof connector. The female connector 1 has a connector housing having a hood 3 at a forward end thereof. A terminal receiving or accommodating chamber 7 is formed at a forward part of a connector housing 5. A waterproof-plug mounting section 9 is formed at a rearward part of the female connector 1. A male terminal 13 which is connected in caulking to a wire 11 is accommodated within the terminal accommodating chamber 7. A male electric connecting part 15 of the male terminal 13 projects within the hood 3. As shown in FIG. 2, a waterproof plug 17 made of rubber is fitted about the wire 11 at a location immediately after the male terminal 13. The waterproof plug 17 has an outer peripheral portion thereof which is in elastic contact with the waterproof-plug mounting section 9 of the connector housing 5. Further, although not shown, a male connector to be joined to the female connector 1 is sealed by a similar structure. The male connector (not shown) is joined to the female connector 1, whereby waterproof within the connector can be executed by the waterproof plug 17 of the female connector 1 and a waterproof plug of the male connector (not shown).

However, the above-described structure has the following problems. That is, the above-described structure is arranged such that the waterproof plug 17 mounted beforehand on the wire 11 is forcibly pressed into the waterproof mounting section 9 as well as accommodation of the male terminal 13, and the waterproof mounting section 9 is crushed or smashed radially, whereby the waterproof plug 17 is into close contact with the inner periphery of the waterproof mounting section 9 and the wire 11, to thereby execute sealing. Accordingly, seal function becomes insufficient, or pressing operation will become difficult. Moreover, the arrangement cannot cope with a change or alteration in thickness of the wire 11.

Specifically, the above-described arrangement is such that seal is executed only by forcible pressing of the waterproof plug 17 into the waterproof mounting portion 9. Accordingly, if an attempt is made to facilitate the pressing operation, the outer diameter of the waterproof plug 17 cannot so much increase with respect to the inner diameter of the waterproof mounting section 9. Thus, it is impossible to secure a sufficient crushing width or margin, and there is a fear that the seal function becomes insufficient.

Reversely, in a case where the seal function is sufficiently secured, the outer diameter of the waterproof plug 17 increases with respect to the inner diameter of the waterproof mounting section 9, to secure a sufficient crushing margin. However, in this case there is a problem that pressing operation of the waterproof plug 17 with respect to the waterproof mounting section 9 becomes difficult.

Furthermore, the above-described arrangement has the following problem. That is in a case where thickness of the wire 11 has a prescribed dimension with respect to the inner diameter of the waterproof plug 17, it is possible to secure sufficient seal function by pressing of the waterproof plug 17. However, in a case where the thickness of the wire 11 is reduced with respect to the inner diameter d of the waterproof plug 17 as illustrated in FIG. 2 by a change in specification so that a gap e is defined between the waterproof plug 17 and the wire 11, it is impossible to exhibit or provide sufficient seal function. Thus, the arrangement cannot cope with a change in thickness of the wire.

Moreover, there is the following problem. That is, the waterproof plug 17 must be fitted about the wire 11 before the male terminal 13 is connected to the wire 11 by caulking. Thus, a degree of freedom of mounting operation is restricted.

SUMMARY OF THE INVENTION

It is therefore an object of the invention to provide a waterproof connector which can sufficiently secure seal function, which can facilitate waterproof-plug mounting operation, which can increase a degree of freedom of mounting operation, and which can cope with a change in thickness of a wire.

According to the invention, there is provided a waterproof connector for accommodating therein a terminal which is connected to a wire, said waterproof connector comprising:

a housing having a terminal accommodating chamber for accommodating therein said terminal connected to said wire, and a waterproof-plug mounting section in communication with said terminal accommodating chamber, said waterproof-plug mounting section being provided with an opening at one end thereof;

a waterproof plug inserted into said waterproof-plug mounting section through said opening, said waterproof plug having an inserting bore into which said terminal connected to said wire is inserted, said waterproof plug being arranged such that said waterproof plug swells radially so as to be into close contact with said wire and said waterproof-plug mounting section by being axially compressed; and an urging element for axially compressing said waterproof plug so as to be engaged with said housing.

When mounting, the waterproof plug is received or accommodated in the waterproof-plug mounting portion, and the urging element is inserted into the rearward opening in the housing. Then, the terminal connected to the wire is inserted through the terminal inserting bore in the waterproof plug holder, and is accommodated in the terminal accommodating chamber through the inserting bore in the waterproof plug. Under this condition, the wire at the rearward end of the terminal is inserted through the inserting bore in the waterproof plug.

Then, when the urging element is further pressed and the waterproof plug is compressed in the inserting direction, the outer periphery of the waterproof plug increase in diameter, and the inner periphery of the waterproof plug is reduced in diameter. Accordingly, the outer periphery of the waterproof plug come in close contact with the inner periphery of the waterproof mounting portion, and the inner periphery of the waterproof plug is come in close contact with the wire.

DETAILED DESCRIPTION OF THE PREFERRED EMBODIMENTS

Various embodiments of the invention will hereunder be described with reference to the accompanying drawings.

Figure 1:
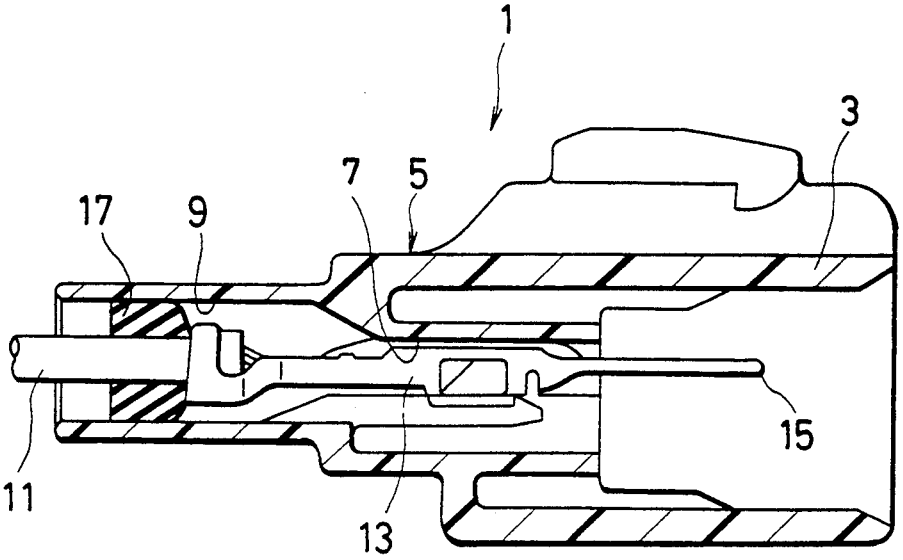
FIG. 1 PRIOR ART
FIG. 1 is a cross-sectional view showing a conventional waterproof connector.
Figure 2:
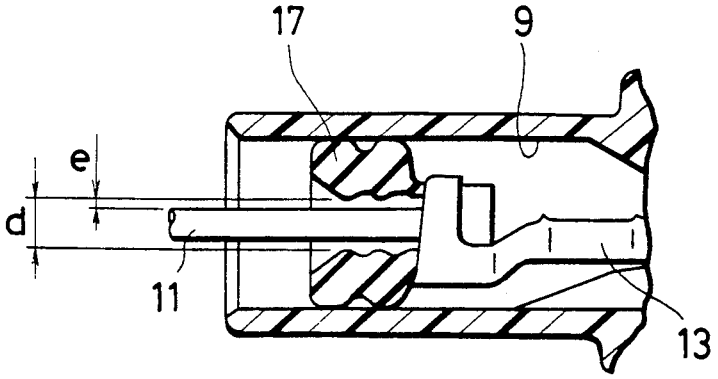
FIG. 2 PRIOR ART
FIG. 2 is an enlarged view showing, in enlargement, a waterproof-plug mounting section of the conventional waterproof connector illustrated in FIG. 1.
Figure 3:
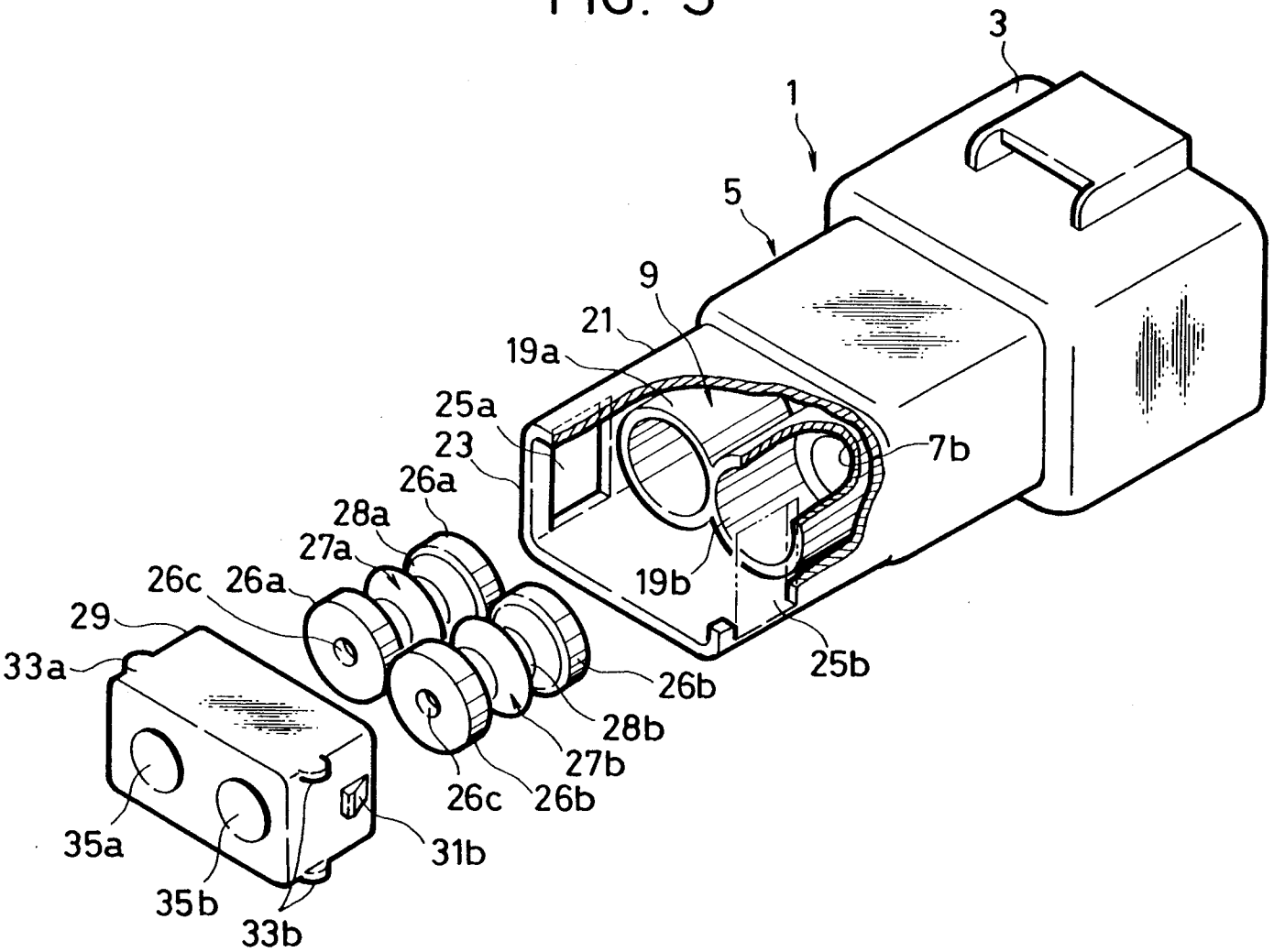
FIG. 3 is an exploded perspective view showing, in a partially cut-away manner, a waterproof connector according to a first embodiment of the invention.
Figure 4:
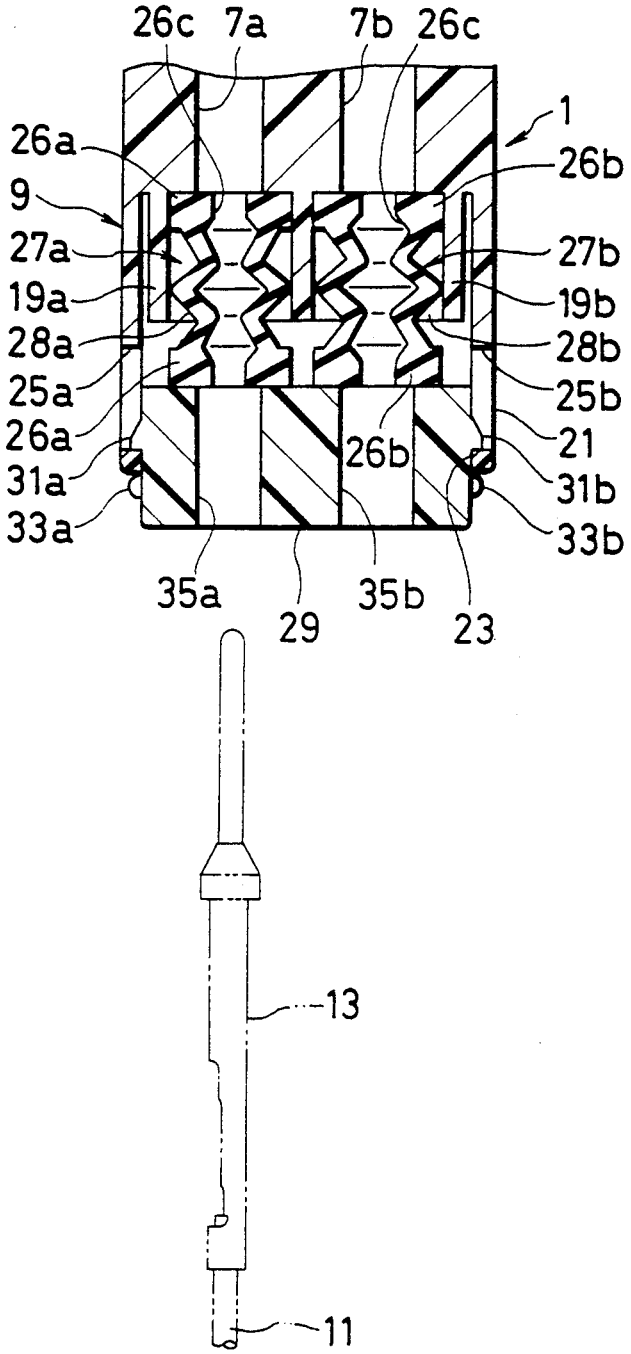
FIG. 4 is an enlarged view showing, in enlargement, a waterproof-plug mounting section of the waterproof connector illustrated in FIG. 3.

FIG. 3 is a perspective view showing a waterproof connector according to a first embedment of the invention under a condition before a waterproof plug is mounted, while FIG. 4 is a cross-sectional view of a principal portion, showing a provisional engagement condition. A female connector 1 is provided with a connector housing 5. The connector housing 5 is provided, at a front portion thereof, with a hood 3. The connector housing 5 is provided, at a central portion thereof, with a pair of terminal accommodating chambers 7*a* and 7*b*, and, at a rear part thereof, with a waterproof-plug mounting section 9. The waterproof-plug mounting section 9 is arranged such that a pair of cylindrical seal cavities 19*a* and 19*b* project respectively at rearward ends of the respective terminal accommodating chambers 7*a* and 7*b*. The connector housing 5 has a rearward part 21 thereof which is located peripherally of the seal cavities 19*a* and 19*b*. Thus, the waterproof-plug mounting section 9 is of double structure.

A rearward opening 23 in the connector housing 5 slightly projects rearwardly from the seal cavities 19*a* and 19*b*. The rearward opening 23 has both left- and right-hand sides which are provided respectively with engaging portions 25*a* and 25*b* each of which is formed by a rectangular through bore.

Further, the female connector 1 is provided with a pair of bellows-like waterproof plugs 27*a* and 27*b* which are mounted into the waterproof-plug mounting portion 9. The female connector 1 is provided with a waterproof-plug holder 29 serving as an urging element which is inserted into the rearward opening 23 in the connector housing 5. Each of the waterproof plugs 27*a* and 27*b* is provided, at both ends thereof, with a pair of abutment portions 26*a* and 26*a*, 26*b* and 26*b*, and at a central portion, with a bellows portion 28*a*, 28*b*. The waterproof plugs 27*a* and 27*b* have respective inserting bores 26*c* and 26*c* therein into which a pair of male terminals 13 connected respectively to wires 11 are inserted respectively. The bellows portions 28*a* and 28*b* are axially compressed whereby the bellow portions 28*a* and 28*b* swell radially outwardly and inwardly. Namely, the outer peripheries of the bellow portions 28*a* and 28*b* increase in diameter, and the inner peripheries of the bellow portions 28*a* and 28*b* are reduced in diameter.

A pair of provisional engaging portions 31*a* and 31*b* for provisional engagement engaged respectively with the engaging portions 25*a* and 25*b* of the rearward-end opening 23, and a pair of actual engaging portions 33*a* and 33*b* for actual engagement are provided respectively on the side surface of the waterproof-plug holder 29 with a predetermined interval between the provisional engagement portion 31*a*, 31*b* and the actual engaging portions 33*a*, 33*b* in an inserting direction. Moreover, the waterproof-plug holder 29 is provided with a pair of terminal inserting bores 35*a* and 35*b* which communicate respectively with the seal cavities 19*a* and 19*b* in the waterproof-plug mounting section 9.

When assembling, the waterproof plugs 27*a* and 27*b* are mounted respectively into the seal cavities 19*a* and 19*b* in the waterproof-plug mounting section 9, and the waterproof-plug holder 29 is inserted into the rearward opening 23 in the connector housing 5 as shown in FIG. 4. Thus, the connector housing 1 and the waterproof-plug holder 29 are brought to a provisional engagement condition.

Figure 5:
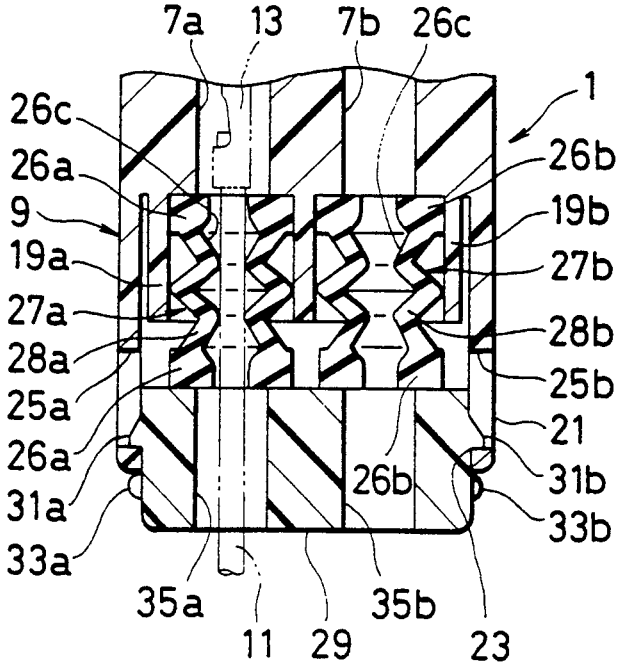
FIG. 5 is an enlarged view showing, in enlargement, the waterproof-plug mounting section of the waterproof connector illustrated in FIG. 3, showing a provisionally engaged condition.

Specifically, the waterproof-plug holder 29 is opposed against the rearward opening 23, and is pushed thereinto as it is, so that the provisional engaging portions 31*a* and 31*b* are engaged respectively with the engaging portions 25*a* and 25*b*. Under this condition, the waterproof plugs 27*a* and 27*b* are not compressed axially. The waterproof plugs 27*a* and 27*b* are brought to a condition under which the waterproof plugs 27*a* and 27*b* are in light contact with the end surface of the waterproof-plug holder 29 under such a condition that the waterproof plugs 27*a* and 27*b* project respectively from the seal cavities 19*a* and 19*b* in the waterproof-plug mounting portion 9. Accordingly, the bellows portions 28*a* and 28*b* of the respective waterproof plugs 27*a* and 27*b* are not at all deformed, but the inner peripheries of the respective bellows portions 28*a* and 28*b* are brought to a spreading condition. Under this condition, the male terminal 13 joined to the wire 11 is inserted from each of the terminal inserting bores 35*a* and 35*b* in the waterproof-plug holder 29, so that the male terminal 13 is accommodated in the terminal accommodating chamber 7*a* or 7*b* through the inserting bores 26*c* and 26*c* of the waterproof plug 27*a* or 27*b*. At this time, the wire 11 immediately behind the male terminal 13 is located at the inserting bores 26*c* and 26*c* of the waterproof plug 27*a* or 27*b*, as shown in FIG. 5. When such insertion of the male terminal 13, inserting operation is extremely easy because the waterproof plugs 27*a* and 27*b* are brought to a spread condition, that is a condition the inner peripheries of the bellow portions 28*a* and 28*b* are not reduced in diameter yet, as described previously.

Figure 6:
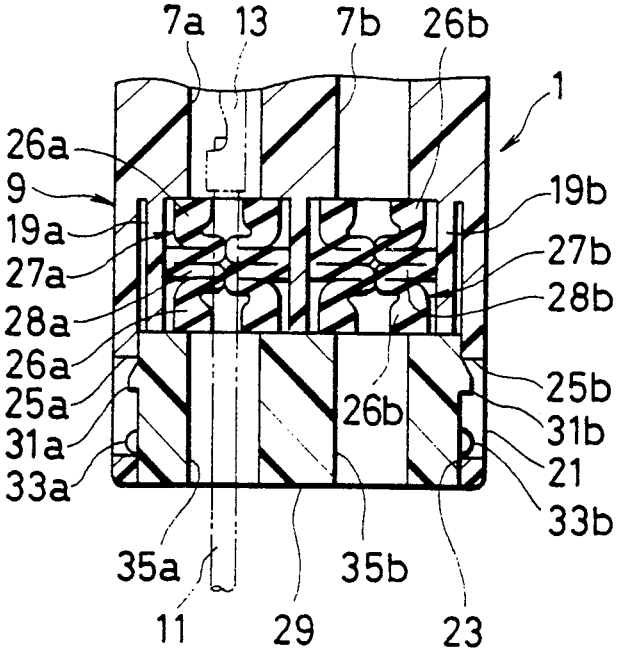
FIG. 6 is an enlarged view showing, in enlargement, the waterproof-plug mounting portion of the waterproof connector illustrated in FIG. 3, showing an actually engaged condition.

When the waterproof-plug holder 29 is further pressed so that the actual engaging portions 33*a* and 33*b* are engaged respectively with the engaging portions 25*a* and 25*b* as shown in FIG. 6, the waterproof-plug holder 29 is brought to an actually engaged condition. The waterproof plugs 27*a* and 27*b* are brought to such a condition as to be pressed respectively into the seal cavities 19*a* and 19*b* and are compressed as a whole.

Figure 7:
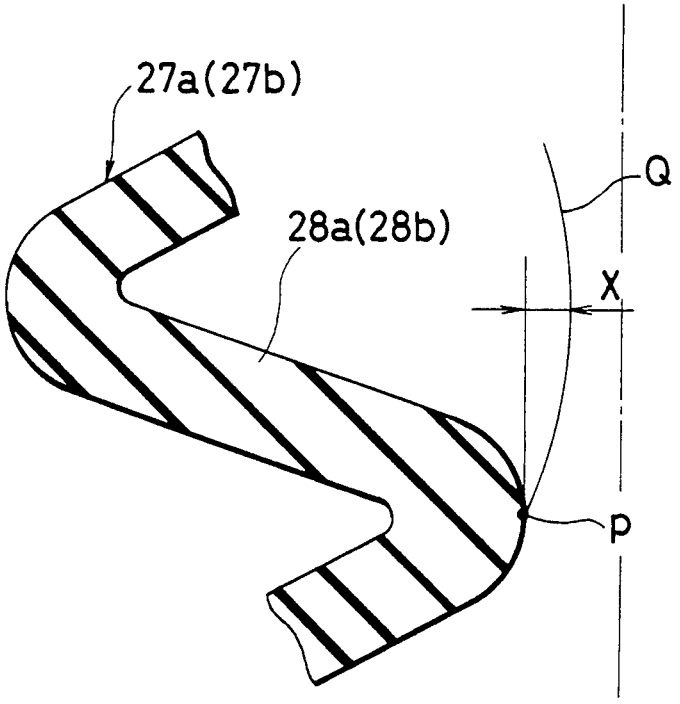
FIG. 7 is an enlarged cross-sectional view showing, in enlargement, a portion of a waterproof plug of the waterproof connector illustrated in FIG. 3.

At this time, as shown in FIG. 7, a point p of each of the bellows portions 28*a* and 28*b* describes a locus of an arc Q, and is brought a condition that the point p swells by x of inward and outward movements in all. For this reason, the waterproof plugs 27*a* and 27*b* have respective inner peripheries thereof which are certainly into close contact with the wire 11, and respective outer peripheries which are certainly into close contact respectively with the inner peripheries of the seal cavities 19*a* and 19*b*, so that it is possible to execute seal. When mounting of the waterproof plugs 27*a* and 27*b* into the seal cavities 19*a* and 19*b*, the mounting operation is extremely facilitated because the inner and outer peripheries of the waterproof plugs 27*a* and 27*b* do not swell yet. Moreover, it is not required that the waterproof plugs 27*a* and 27*b* are mounted beforehand on the wire 11. Thus, a degree of freedom of operation increases. Further, seal is secured by radial swelling of the bellows portions 28*a* and 28*b* due to axial compression. Accordingly, even if there is a change in thickness of the wire 11, it is possible to cope with such change.

In connection with the above, although the above-described embodiment is arranged such that the waterproof-plug holder and the waterproof plugs are formed separately from each other, it is possible to form the waterproof-plug holder and the waterproof plugs integrally. In this case, since the waterproof-plug holder and the waterproof plugs can be treated or handled as an integral object, it is made possible to further easily execute mounting operation of the waterproof-plug.

Figure 8:
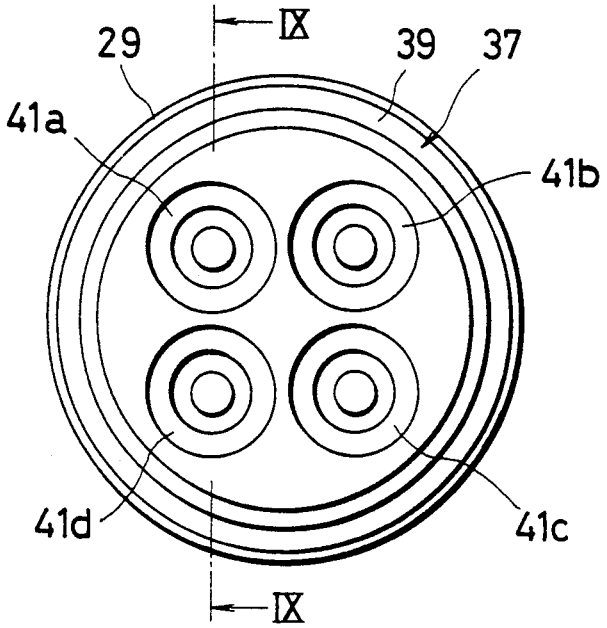
FIG. 8 is a front elevational view of a waterproof plug and a waterproof-plug holder which are provided on a waterproof connector according to a second embodiment of the invention.
Figure 9:
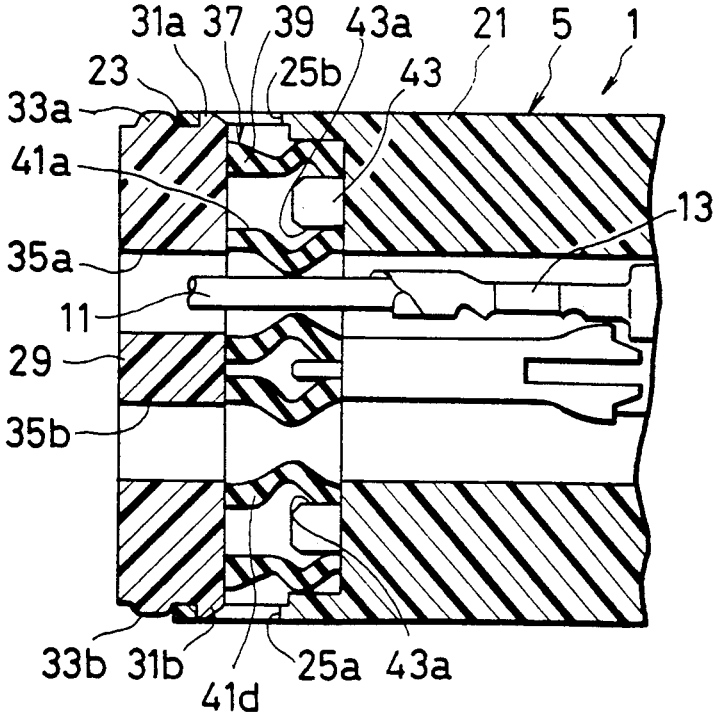
FIG. 9 is a cross-sectional view taken along a line IX—IX in FIG. 8, and a cross-sectional view showing a condition under which the waterproof plug is mounted on a female connector.

FIGS. 8 and 9 show a second embodiment of the invention. FIG. 8 is a front elevational view of a waterproof-plug holder 29 and a waterproof plug 37. The waterproof plug 37 has, in an integral manner, a first waterproof plug 39 having a bellows structure which is large in diameter and a single, and four (4) second waterproof plugs 41*a*~41*d* each of which is a small diameter and has a bellow structure. The first and second waterproof plugs 39 and 41*a*~41*d* present a single angle bellows and have respective one ends thereof which are fixed to the waterproof-plug holder 29 by adhesion or the like. In this connection, similarly to the above-described embodiment, the first and second waterproof plugs 39 and 41*a*~41*d* and the waterproof-plug holder 29 can be brought to a separable structure.

On the other hand, each of the seal ring 43 has an outer periphery thereof which presents a ring-like configuration. Insides of the respective seal ring 43 serve respectively as accommodating portions 43*a* for the respective second waterproof plugs 41*a*~41*d*.

When the waterproof-plug holder 29 is inserted into a rearward opening 23 in a connector housing 5 as shown in FIG. 9 so as to be brought to a provisional engagement condition, the first waterproof plug 39 is inserted into a location between the outer periphery of the seal ring 43 and the inner periphery of a rearward part 21 of the connector housing 5. Thus, the second waterproof plugs 41*a*~41*d* are received or accommodated respectively in the accommodating portions 43*a*.

If the waterproof-plug holder 29 is under the actual engagement condition, the first waterproof plug 39 is into close contact with the outer peripheries of the respective seal ring 43 and the inner periphery of the rearward part 21 of the connector housing 5 so that locations therebetween are sealed. The second waterproof plugs 41*a*~41*d* are into close contact respectively with the seal cavities 43 and the wire 11 by compression of the second waterproof plugs 41*a*~41*d* in the inserting direction, so that locations therebetween are sealed.

In this manner, the present embodiment can produce functional advantages similar to those of the aforesaid embodiment and, in addition thereto, sealing can be made both by the inside and the outside of each of the seal ring 43. Thus, sealability can further by improved. In addition, same reference numerals designate similar portions to those of the first embodiment, respectively.

A third embodiment of the invention will next be described.

Figure 10:
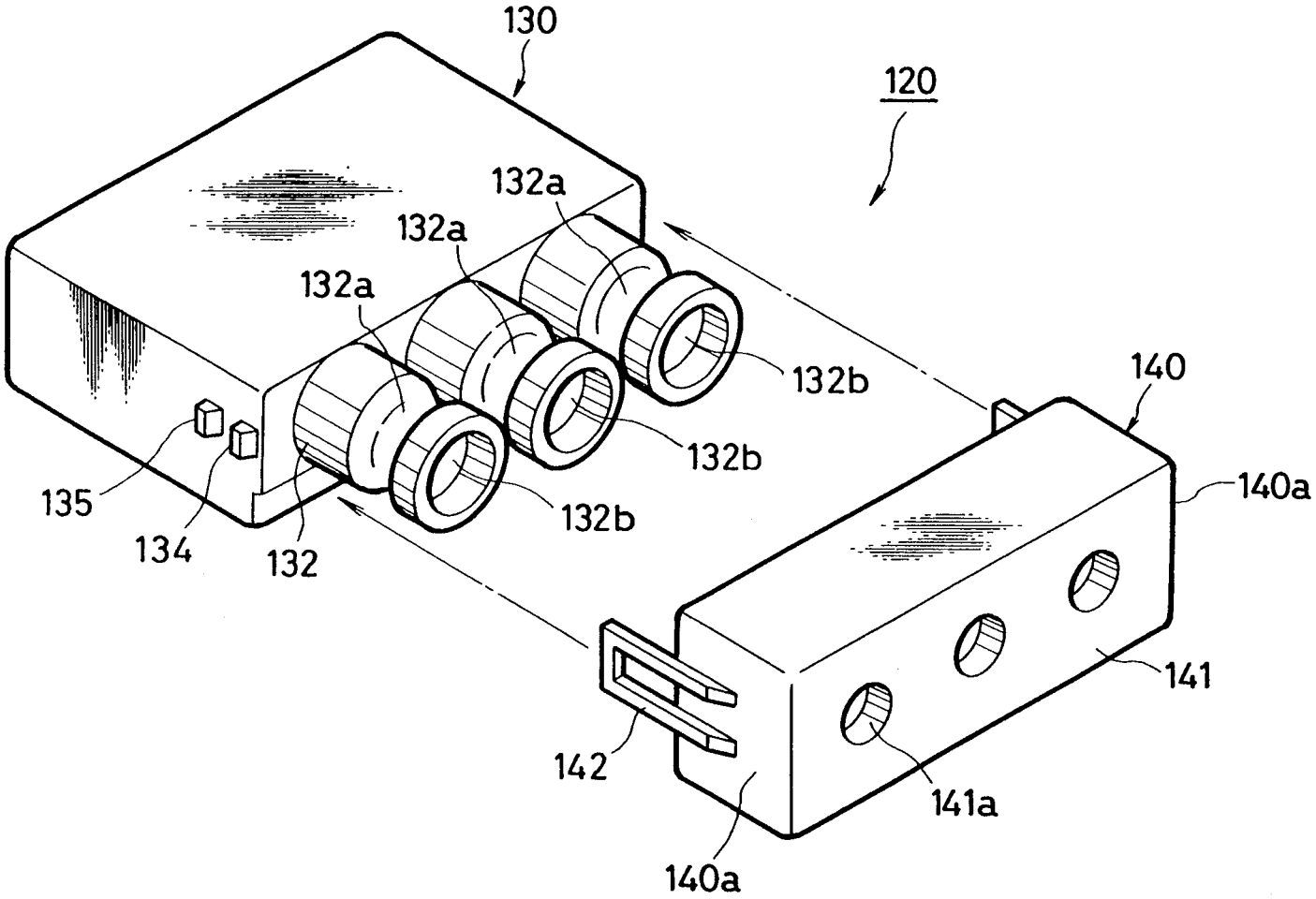
FIG. 10 is an exploded perspective view showing a waterproof connector according to a third embodiment of the invention.

FIG. 10 shows an embodiment of a waterproof connector according to the invention. In FIG. 10, a waterproof connector 120 comprises a box-like connector housing 130 for accommodating therein a plurality of terminals, and a cap-like terminal inserting-portion holder 140 used for prevention of water from being flooded into the connector housing 130.

Figure 12:
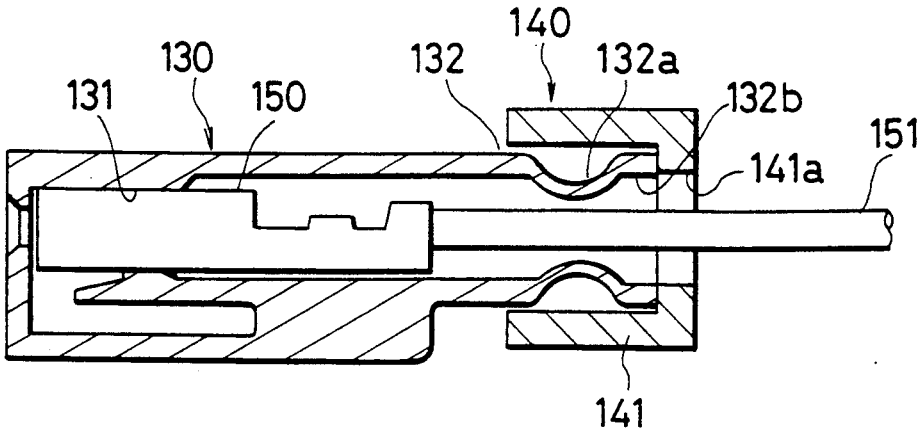
FIG. 12 is a cross-sectional view showing the condition illustrated in FIG. 11, in cross-section in an inserting direction.

As shown in FIG. 12, the connector housing 130 is provided therein with a plurality of terminal accommodating chambers 131 capable of accommodating respectively therein terminals 150. The connector housing 130 is formed with a plurality of tubular terminal inserting portions 132 which extend rearwardly from their respective terminal accommodating chambers 131. A respective annular recesses 132*a* each of which has a wall thereof and each of which is thinner than the neighboring wall thickness are provided respectively at intermediate portions of the respective terminal inserting portions 132, to constrict the intermediate portions. For this reason, when the terminal inserting portions 132 are compressed in the terminal inserting direction, the annular recesses 132*a* are reduced in diameter. When the compressive condition is released, the annular recesses 132*a* are enlarged in diameter. Thus, the terminal inserting portions 132 are restored.

Figure 11:
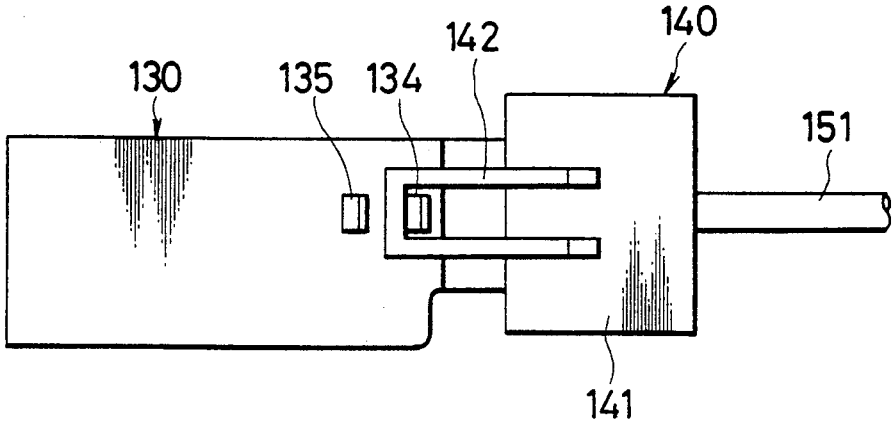
FIG. 11 is a side elevational view showing a condition under which, in the waterproof connector illustrated in FIG. 10, a plurality of engaging arms are engaged respectively with a plurality of provisional engagement projections and a plurality of terminals are inserted respectively into a plurality of terminal inserting bores.

Further, as shown in FIGS. 10 and 11, the connector housing 130 has an outer surface thereof which is provided with a pair of provisional engaging projections 134 at locations adjacent respectively to the terminal inserting portions 132. Moreover, a pair of actual engaging projections 135 are provided in spaced relation respectively to the provisional engaging projections 134 by a predetermined length in the inserting direction of the terminal 150.

The terminal inserting-portion holder 140 comprises a base portion 141 in form of a cap capable of being fitted onto the terminal inserting portion 132, and a pair of engaging arms 142 projecting forwardly respectively from opposed both side walls 140*a* and 140*a* and serving respectively as a pair of elastic portions to be engaged which can successively be engaged respectively with the provisional engaging projections 134 on both side walls of the connector housing 130, and the actual engaging projections 135.

The base portion 141 has a rear wall thereof which is provided therein with a plurality of terminal inserting bores 141*a* which are arranged at locations opposed respectively against terminal inserting bores 132*b* in the terminal inserting portions 132 and which have respective diameters thereof identical respectively with or equivalent respectively to those of rearward ends of the terminal inserting portions 132, when the base portion 141 is fitted onto the terminal inserting portions 132.

Connection of the terminal 150 to the waterproof connector 120 arranged as described above is executed as follows. That is, as shown in FIGS. 11 and 12, the terminal inserting portions 132 of the connector housing 130 are first covered with the inserting holder 140. The provisional engaging projections 134 of the connector housing 130 are engaged respectively with the engaging arm 142 of the terminal inserting-portion holder 140, to provisionally engage the terminal inserting-portion holder 140 with the connector housing 130. At this time, the terminal inserting bores 132*b* in the respective terminal inserting portion 132 of the connector housing 130 are opposed respectively against the terminal inserting bores 141*a* in the terminal inserting-portion holder 140. Further, the terminal inserting portions 132 are not compressed in the terminal inserting direction. For this reason, the annular recesses 132*a* in the respective terminal inserting portions 132 is brought to such a condition as not to be reduced in diameter.

Subsequently, the terminals 150 are inserted respectively into the terminal inserting portions 132. Under this condition, since the annular recesses 132*a* in the respective terminal inserting portions 132 are not reduced in diameter, it is possible to easily insert the terminals 150 into the respective terminal inserting portions 132.

Figure 13:
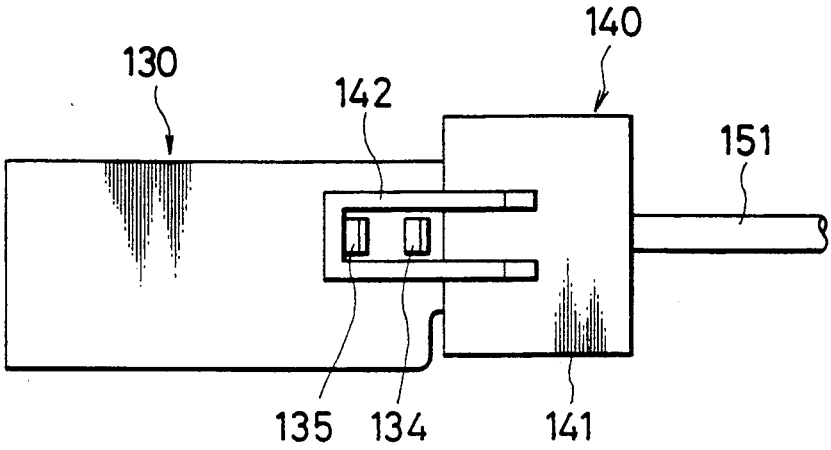
FIG. 13 is a side elevational view showing a condition under which the engaging arms are engaged respectively with the engaging projections and terminals are respectively inserted into the terminal inserting bores.
Figure 14:
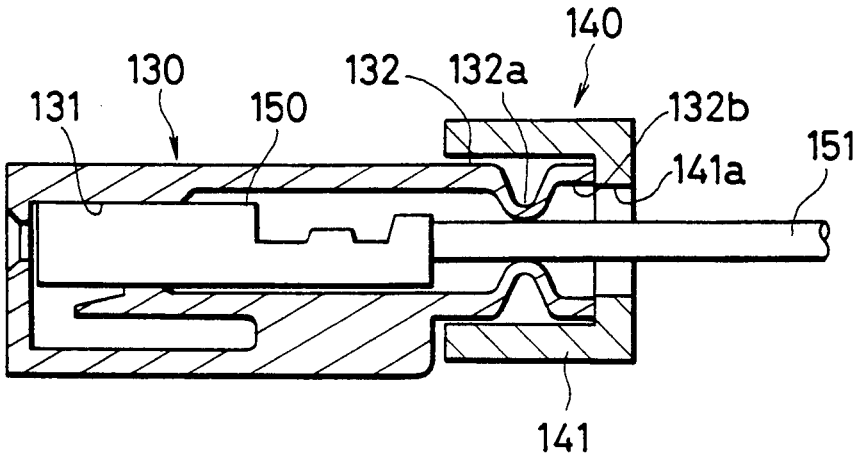
FIG. 14 is a cross-sectional view showing the condition illustrated in FIG. 13, in cross-section in the inserting direction.

Moreover, when the terminal inserting-portion holder 140 is pressed toward the connector housing 130 from this condition, the terminal inserting portions 132 of the connector housing 130 are compressed in the terminal inserting direction, and the annular recesses 132*a* of the respective terminal inserting portions 132 are gradually reduced in diameter. As shown in FIGS. 13 and 14, when the annular recesses 132*a* are perfectly into close contact respectively with wires 151 to which the terminals 150 are connected, respectively, the engaging arms 142 of the terminal inserting-portion holder 140 are engaged respectively with the actual engaging projections 135 of the connector housing 130. Thus, actual engagement can be executed. In this manner, when the engaging arms 142 are engaged respectively with the actual engagement projections 135, connection between the waterproof connector 120 and the terminals 150 is completed.

Under a condition that the terminals 150 are connected to the waterproof connector 120 arranged as described above, the annular recesses 132*a* in the respective terminal inserting portions 132 are in close contact respectively with the wires 151 to which the terminals 150 are connected respectively. Accordingly, it is possible to prevent water from being flooded into the terminal accommodating chambers 131 of the waterproof connector 120.

Furthermore, when the terminals 150 are connected to the waterproof connector 120, it is possible to easily insert the terminals 150 into the respective terminal inserting portions 132 under such a condition that the terminal inserting portions 132 are not reduced in diameter. After insertion of the terminals 150, the terminal inserting portion 140 is pressed toward the connector housing 130, and the engaging arms 142 of the terminal inserting-portion holder 140 are only engaged respectively with the actual engaging projections 135 on the connector housing 130. Accordingly, it is possible to considerably improve operability at the time the waterproof connector 120 and the terminals 150 are connected to each other.

Further, it is not required for the present embodiment to pressingly fit annular elastic elements respectively to the wires to which the terminals are connected like the conventional example set beforehand. Thus, assembling operation can be facilitated.

In connection with the above, the present embodiment is arranged such that the base portion 141 of the terminal inserting-portion holder 140 is brought to a cap-like configuration and so fitted as to cover the terminal inserting portions 132. However, the invention should not be limited to this specific arrangement. The arrangement may be such that the base portion 141 is merely formed into a plate, and is abutted against the rearward ends of the respective terminal inserting portions 132. In this case, it should be arranged such that, when the engaging arms 142 are engaged respectively with the provisional engagement projections 134, the terminal inserting portions 132 are compressed to such a degree as not to interfere with insertion of the terminals 150 into the terminal inserting portions 132, to fixedly mount the terminal inserting-portion holder 140 to the connector housing 130, and the positions of the respective terminal inserting bores 132*b* of the terminal inserting portion 132 are opposed against the position of the terminal inserting bore 141*a* of the base portion 141. With the arrangement, there can also be produced functional advantages similar to those of the aforesaid embodiment.

What is claimed is:

1. A waterproof connector for accommodating therein a terminal which is connected to a wire, said waterproof connector comprising:

a housing having a terminal accommodating chamber for accommodating therein said terminal connected to said wire, and a waterproof-plug mounting section in communication with said terminal accommodating chamber, said waterproof-plug mounting section being provided with an opening at one end thereof;

a waterproof plug inserted into said waterproof-plug mounting section through said opening, said waterproof plug having a receiving bore adapted to receive said terminal connected to said wire, said waterproof plug having abutments at both ends thereof and having a bellows portion at a central portion thereof, wherein said bellows portion is arranged such that said bellows portion swells radially outwardly and inwardly so as to come into close contact with said wire and said waterproof-plug mounting section by being axially compressed; and an urging element for axially compressing said waterproof plug so as to be engaged with said housing.

2. A waterproof connector according to claim 1, wherein said waterproof plug and said urging element are integrally connected to each other.

3. A waterproof connector for accommodating therein a terminal which is connected to a wire, said waterproof connector comprising:

a housing having a terminal accommodating chamber for accommodating therein said terminal connected to said wire, and a waterproof-plug mounting section in communication with said terminal accommodating chamber, said waterproof-plug mounting section being provided with an opening at one end thereof;

a waterproof plug inserted into said waterproof-plug mounting section through said opening, said waterproof plug having an inserting bore into which said terminal connected to said wire is inserted, said waterproof plug being arranged such that said waterproof plug swells radially so as to come into close contact with said wire and said waterproof-plug mounting section by being axially compressed;

an urging element for axially compressing said waterproof plug so as to be engaged with said housing; and engaging means for engaging said urging element with said housing, said engaging means having an engaging portion provided on said housing, a provisional engaging portion provided on said urging element so as to be capable of being engaged with said engaging portion, and an actual engaging portion provided on said urging element so as to be capable of being engaged with said engaging portion and arranged at axial intervals with respect to said provisional engaging portion.

4. A waterproof connector according to claim 3, wherein said waterproof plug and said urging element are integrally connected to each other.

5. A waterproof connector for accommodating therein a terminal which is connected to a wire, said waterproof connector comprising;

a housing having a terminal accommodating chamber for accommodating therein said terminal connected to said wire, and a waterproof-plug mounting section in communication with said terminal accommodating chamber, said waterproof-plug mounting section being provided with an opening at one end thereof;

a waterproof plug inserted into said waterproof-plug mounting section through said opening, said waterproof plug having a plurality of inserting bores into which said terminal connected to said wire is inserted, said waterproof plug having an outer peripheral portion thereof, a large bellows structure, and a small bellows structure about said inserting bore, said waterproof plug being arranged such that said waterproof plug swells radially so as to come into close contact with said wire and said waterproof-plug mounting section by being axially compressed; and an urging element for axially compressing said waterproof plug so as to be engaged with said housing.

6. A waterproof connector according to claim 5, wherein said waterproof plug and said urging element are integrally connected to each other.

7. A waterproof connector for accommodating therein a terminal which is connected to a wire, said waterproof connector comprising:

a housing having a terminal accommodating chamber for accommodating said terminal connected to said wire and a terminal inserting portion in communication with said terminal accommodating chamber, said terminal inserting portion being of tubular structure which extends from said terminal accommodating chamber;

a waterproof plug portion formed in integral relation to said terminal inserting portion, having an inserting bore into which the terminal connected to said wire is inserted, and being formed such that said tubular structure is reduced in thickness and in diameter so as to be formed into an annular recess, wherein said waterproof plug portion is arranged so as to swell radially to come into close contact with said wire by being axially compressed; and an urging element for compressing said waterproof plug axially so as to be engaged with said housing.

8. A waterproof connector for accommodating therein a terminal which is connected to a wire, said waterproof connector comprising;

a housing having a terminal accommodating chamber for accommodating said terminal connected to said wire and a terminal inserting portion in communication with said terminal accommodating chamber;

a waterproof plug portion formed in integral relation to said terminal inserting portion, and having an inserting bore into which the terminal connected to said wire is inserted, wherein said waterproof plug portion is arranged so as to swell radially to come into close contact with said wire by being axially compressed;

an urging element for compressing said waterproof plug axially so as to be engaged with said housing; and engaging means for engaging said urging element with said housing, said engaging means having an engaging arm provided on said urging element, a provisional engaging portion provided on said housing so as to be capable of being engaged with said engaging arm, and an actual engaging portion provided on said housing so as to be capable of being engaged with said engaging arm and arranged at axial intervals with respect to said provisional engaging portion.

* * * * *